US005099749A

United States Patent [19]

Darish

[11] Patent Number: 5,099,749

[45] Date of Patent: Mar. 31, 1992

[54] COMPOUND MOTION FLUID ACTUATING DEVICE AND METHOD

[76] Inventor: Joseph J. Darish, Rd. #1 County Hill Rd., Lebanon, N.J. 08833

[21] Appl. No.: 510,707

[22] Filed: Apr. 19, 1990

[51] Int. Cl.[5] ..... F01B 21/00

[52] U.S. Cl. ..... 92/2; 92/81; 92/108; 92/110; 91/61

[58] Field of Search ..... 92/2, 31, 33, 81, 107, 92/108, 110, 136; 91/61; 277/30, 31

[56] References Cited

U.S. PATENT DOCUMENTS

| | | | |
|---|---|---|---|
| 1,718,873 | 6/1929 | Osgood | 91/61 |
| 3,353,352 | 11/1967 | Gardner | 92/108 |
| 3,386,340 | 6/1968 | Engle | 91/61 |
| 3,620,132 | 11/1971 | Nitkiewicz | 92/2 |
| 4,005,641 | 2/1977 | Nussbaumer | 92/108 |
| 4,192,482 | 3/1980 | Goldman et al. | 92/2 |
| 4,350,348 | 9/1982 | Cox | 277/31 |
| 4,824,255 | 4/1989 | Wohlrab | 92/108 |

FOREIGN PATENT DOCUMENTS

| | | | |
|---|---|---|---|
| 665568 | 6/1963 | Canada | 92/2 |
| 1222076 | 6/1960 | France | 91/61 |
| 0646104 | 2/1979 | U.S.S.R. | 92/2 |

*Primary Examiner*—Edward K. Look
*Assistant Examiner*—Thomas E. Denion
*Attorney, Agent, or Firm*—White & Case

[57] ABSTRACT

A rotary/linear fluid actuator includes a cylinder closed at one end by a rotary actuator and at its other end by a forward housing. A piston is disposed in the cylinder. A hollow piston rod, the forward end of which is closed, extends out of the cylinder through the forward housing. A splined shaft extends into the open end of the piston rod and is coupled to the rotary actuator. The splined shaft includes an axial bore therethrough for delivering pressurized fluid to the piston rod cavity to cause extension of the piston. The piston, cylinder and forward housing define a cavity which is pressurized to cause retraction of the piston. According to the invention, the size of the piston surface can be selected independent of the size of the piston rod cavity actuation surface so that extension and retraction forces, and thereby fluid requirements are independent of one another.

6 Claims, 2 Drawing Sheets

COMPOUND MOTION FLUID ACTUATING DEVICE AND METHOD

BACKGROUND OF THE INVENTION

This invention is an improvement in a rotary/linear fluid actuator, and in particular a compound motion fluid actuator.

The compound motion fluid actuator is a versatile device used in many areas of industry and is capable of producing reciprocal and rotary motion both simultaneously or separately. In industry, a compound motion fluid actuator is often used to perform strenuous tasks at high speeds. One such task is the rapid clamping of assembly line materials. For example, an actuator can be set level with the assembly line work surface during the loading stage of a material. When the material arrives at a desired operation section, the actuator utilizes reciprocal and rotary motion to move up from the work surface, turn into position, and clamp down the work piece so that a desired work operation can be performed on the material on the line. Upon completion of the work operation, the actuator reverses upon which the material is released.

U.S. Pat. No. 3,815,479 to Thompson discloses a design for a compound motion fluid actuator which includes in effect, two separate actuators with a complex coupling mechanism. This is necessary in order to seal the working parts of the rotary actuator from the pressure cavity during reciprocal motion.

In accordance with U.S. Pat. No. 3,815,479, to achieve reciprocal motion, a power cylinder is pressurized on opposite sides of an internal piston. As cylinder pressure increases, so does the internally communicated pressure, causing stress and fatigue on the working parts of the rotary actuator. Another major problem arises when the cylinder bore size increases. As the bore size increases the amount of fluid needed to fill the bore increases. At high speeds, an expensive power unit must be employed to support the necessary fluid flow rates. The result is a costly, bulky device requiring a high fluid flow rate and needing too much space to operate in conjunction with any surrounding equipment.

In accordance with the invention, an actuator can obtain higher clamping forces and speed at lower fluid flow rates, remain relatively small, and reduce internal stress caused by simultaneous reciprocal and rotary motion. In addition, longer extension can be obtained while keeping the fluid pressure flow rate down.

SUMMARY OF THE INVENTION

The present invention is an improved compound motion fluid actuator which provides reciprocal and rotary motion either simultaneously or independently.

The rotary actuator is made up of a housing, which encloses preferably a fluid actuated rotation device. The actuator is coupled to a spline shaft which extends into a linear actuator cylinder.

The linear actuator cylinder encloses a hollow piston rod which can both reciprocate and rotate within the power cylinder. The hollow piston rod protrudes through the free end of the cylinder which is sealed. The spline shaft telescopically fits into and is axially connected to the hollow piston rod so that the piston rod can move along the shaft, but rotates with the spline shaft. The shaft includes an axial bore for introducing pressurized fluid into the hollow piston rod for forcing the rod forward, i.e., to extend. Retraction of the piston rod is accomplished by pressurizing the fluid pressure chamber between the piston and the cylinder. For a better understanding of the invention, reference is made to the following detailed description of a preferred embodiment taken in conjunction with the drawing accompanying the application.

DETAILED DESCRIPTION OF THE PREFERRED EMBODIMENT

Figure 1:
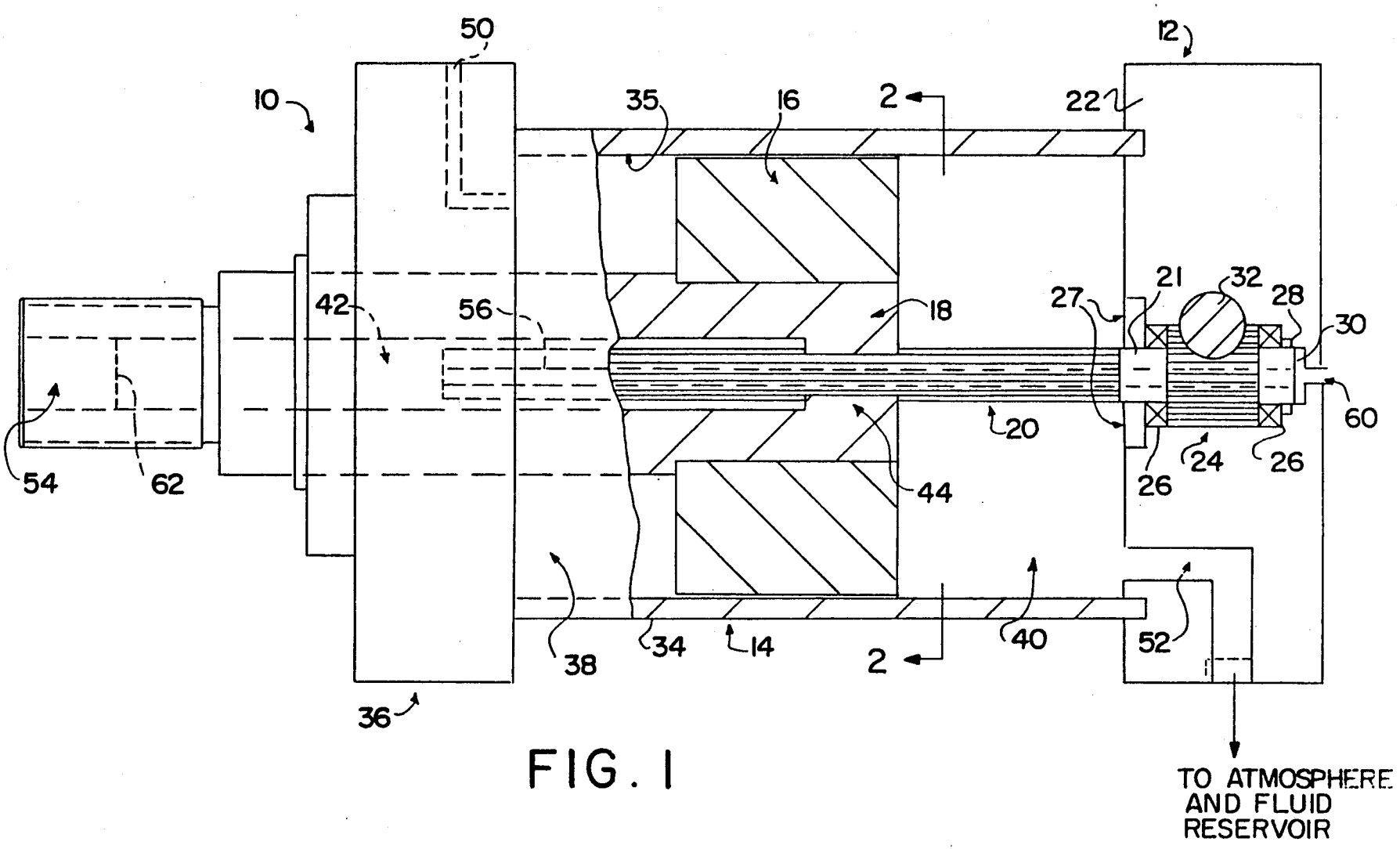
FIG. 1 is a longitudinal view, partially in section, of one embodiment of this invention.
Figure 2:
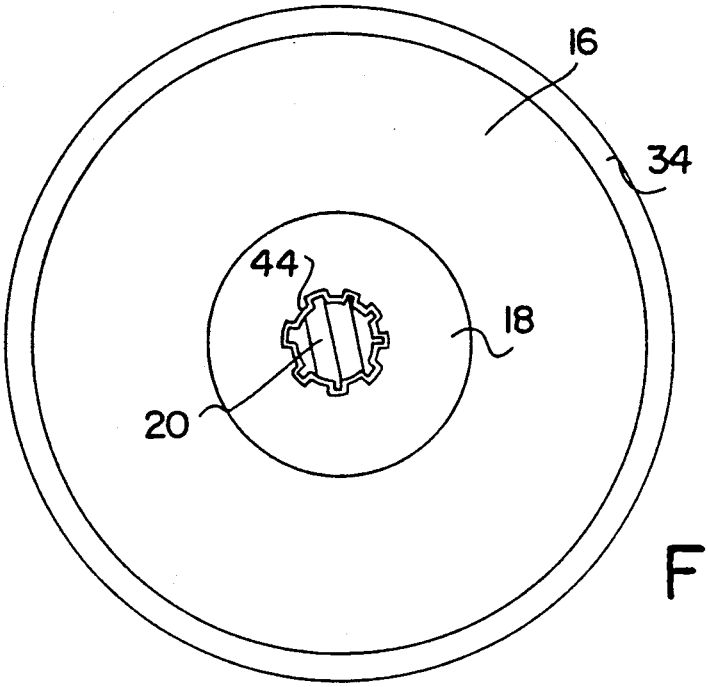
FIG. 2 is a cross-sectional view, taken in the direction of lines 2—2 of FIG. 1.

Referring to the drawings, a rotary/linear fluid actuator 10 includes a rotary actuator 12 for producing rotary motion which is connected to a power cylinder 14 having a reciprocal piston 16, and a piston rod 18. A spline shaft 20 connects the piston 16 and rod 18 to the rotary actuator 12 for imparting rotary motion to the piston rod 18.

As shown in FIG. 1, rotary actuator 12 includes a housing 22 which receives the end 21 of shaft 20. A gear 24 is carried on the end of shaft 20, and bearings 26 on either side of the gear 24 support the smooth end portions of the shaft 20. A cap 27 holds the bearings 26 and gear 24 in the housing 22. Finally, a rotating seal 28 separates the shaft 20 and bearings 26 from an end cavity 30 in the housing 22.

Rotary gear 24 may be driven in any suitable manner, for example by a rack gear 32, which moves perpendicular to the axis of rod 20 and gear 24. Rack gear 32 may be driven hydraulically, in the manner disclosed in U.S. Pat. No. 3,815,479. Other means, including motor such as a stepper motor, however, may be used to rotate the shaft 20. Moreover, shaft end 21 may if desired, constitute a separate shaft piece which is connected to the spline shaft portion 20.

Linear actuator 14 includes a cylinder 34 which is closed at its forward end by an end housing 36, and at its rear end by the rotary actuator housing 22. Piston 16 is disposed in cylinder 34 and bears against the interior cylinder wall 35 so as to define a fluid pressure chamber 38 and a vent cavity 40. A fluid delivery port 50 is provided in end housing 36 for delivering pressurized fluid to chamber 38, and a vent and drain port 52 is provide in housing 22 which communicates between chamber 40 and the fluid reservoir (not shown).

Figure 3:
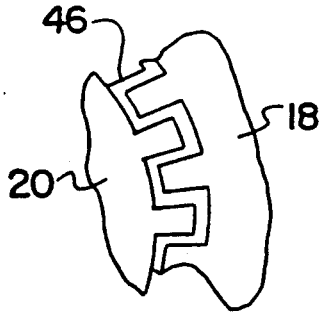
FIG. 3 is an enlarged view of a portion of FIG. 2 showing the engagement of the spline shaft and piston rod.

As shown in FIG. 1, piston rod 18 has an axial bore, defining fluid chamber 42, which receives the forward end of splined shaft 20. The inner end of piston rod 18 engages piston 16, and also includes toothed portion 44 for engaging splined shaft 20. As such, piston rod 18 rotates with shaft 20, but is axially displaceable therealong. As shown in FIG. 3, preferably a tooth shaped annular liner 46 is disposed between the shaft 20 and piston rod 18 so as to act as a seal between cavity 42 and chamber 40. The piston rod 18 extends out from the cylinder 34, through the front housing 36, and the forward end of cavity 42 is closed, for example by plug 54.

Shaft 20 includes a bore 56 that extends axially there through to form a passage between an inlet port 60 in the rotary actuator housing 22 and the fluid cavity 42. Bore 56 may be formed by axially gun-drilling.

In operation, rotary motion of the hollow piston rod 18, and piston 16 is provided by the rotary actuator 12. Reciprocal motion is achieved through the control of admitting and exhausting pressurized fluid into cavities 38 and 42 respectively. To extend the piston rod 18, pressurized fluid is provided to port 60, which is communicated to cavity 42. Fluid force, acting against surface 62, pushes the piston rod 18 forward, sliding along shaft 20. As shown in FIG. 1, when fluid is introduced through port 60, pressurized fluid acts on the opposite end surfaces of spline shaft 20, which are disposed in pressurized cavities 42 and 30, respectively. Because the surface areas of the opposite end surfaces are the same, the resulting axial forces applied to the end surfaces are equal and in opposite directions. Thus, no force is exerted on spline shaft 20 enabling it to rotate freely when cavity 42 is presurrized. When it is desired to retract the piston, pressurized fluid is supplied to port 50, while at the same time allowing the fluid in cavity 42 to return to the reservoir through port 60. Cavity 40 remains at atmospheric pressure and any fluid that may leak through seal 46 is returned to reservoir through drain 52. Reciprocal or rotary motion can proceed simultaneously or separately without any lag on the internal parts.

As can be appreciated, the size of piston 16 can be increased or decreased independent of the size of cavity 42. Thus, if the primary application is to be clamping, which occurs during the retraction cycle of piston movement, a large clamping force can be applied by pressure on piston 16, without the need of increasing fluid delivery to cavity 42 for the extension (release) part of the cycle. By controlling the volume of cavities 42 and 38 the amount of force for each direction can be selected as needed, thus maintaining reasonable fluid flow rates and reducing the cost of the external power unit needed. The pressure can also be increased without any adverse system lag. As can also be appreciated, since there is no pressurized fluid in cavity 40, there is no need, as in the prior art for complex sealing mechanisms between the cavity 40 and the rotary actuator.

In summary, this invention improves upon the current design to achieve compound reciprocal and rotary motion more efficiently. Reciprocal extension and force are increased, internal reactionary lag forces are eliminated resulting in a smaller less costly versatile device.

What is claimed is:

1. A compound motion fluid actuator comprising a cylinder; a piston rod means disposed in said cylinder, wherein said piston rod means has a bore extending axially from one end and is closed at the opposite end; a shaft having opposite end faces and extending into said bore through said one end; means for coupling said shaft to said piston rod means for torsional engagement but to permit said piston rod means to move axially relative to said shaft; rotary actuator means for selectively rotating said shaft and thereby said piston rod means; means for providing pressurized fluid to said bore for causing said piston rod means to move in a direction away from said shaft, wherein pressurized fluid in said bore imparts a reaction force on the end face of said shaft located in said bore; and means for imparting a counteracting force, of substantially equal and opposite magnitude, on said shaft, for permitting free rotation of said shaft while said bore is pressurized.

2. An actuator as defined in claim 1, further comprising means for defining a pressure cavity surrounding said opposite face of the shaft, wherein the shaft includes a through bore extending between opposite ends, and wherein the means for providing pressurized fluid to said bore supplies pressurized fluid to said pressure cavity such that pressurized fluid from said pressure cavity flows through said through bore into the piston rod means bore and pressurizes opposite ends of said shaft.

3. An actuator according to claim 2, wherein said piston rod means includes a piston and piston rod, wherein said piston rod means and cylinder define a fluid cavity, and comprising means for supplying pressurized fluid to said cavity for moving said piston rod means in a direction toward said shaft.

4. An actuator according to claim 3, comprising a forward housing closing a forward end of said cylinder, wherein said piston rod extends out the forward housing, and wherein said fluid cavity is located between said piston and said forward housing.

5. An actuator according to claim 4, comprising a rotary actuator housing closing the rear end of said cylinder, wherein said rotary actuator housing includes said rotary actuator means and defines said pressure chamber.

6. An actuator according to claim 1, wherein the shaft is splined, wherein aid piston rod means includes gear means for engaging the splined shaft for rotation therewith, and comprising a plastic insert between the piston rod means and shaft for forming at least a partial fluid seal.

* * * * *